US005354227A

United States Patent [19]

Watkins

[11] Patent Number: 5,354,227

[45] Date of Patent: Oct. 11, 1994

[54] STREAMERS AND BUBBLES

[76] Inventor: James O. Watkins, 14920 Mt. Nebo Rd., Poolesville, Md. 20837

[21] Appl. No.: 111,609

[22] Filed: Aug. 25, 1993

[51] Int. Cl.[5] ..... A63H 33/30; A63H 33/00

[52] U.S. Cl. ..... 446/475; 446/487; 446/491; 428/906

[58] Field of Search ..... 446/475, 486, 487, 488, 446/489, 490, 491; 428/43, 906

[56] References Cited

U.S. PATENT DOCUMENTS

| | | | |
|---|---|---|---|
| 1,084,636 | 1/1914 | Hunerkopf | 446/475 X |
| 1,090,778 | 3/1914 | Clark | 446/475 |
| 3,648,350 | 3/1972 | Cassidy et al. | 428/906 X |
| 5,015,211 | 5/1991 | Reveen | 446/475 |

FOREIGN PATENT DOCUMENTS

| | | | |
|---|---|---|---|
| 533230 | 9/1931 | Fed. Rep. of Germany | 446/475 |
| 2611605 | 9/1977 | Fed. Rep. of Germany | 446/475 |
| 583242 | 1/1925 | France | 446/475 |
| 625670 | 8/1927 | France | 446/475 |
| 341784 | 1/1931 | United Kingdom | 446/475 |

*Primary Examiner*—Robert A. Hafer
*Assistant Examiner*—D. Neal Muir
*Attorney, Agent, or Firm*—Ronald B. Sherer

[57] ABSTRACT

An amusement device is disclosed in which one or more rolls of lightweight material include a plurality of separate, unconnected strips which are coiled in the roll such that, when the roll is deployed in the air, the unconnected strips separate from the roll of remaining strips, and the separated strips tend to return to their original, coiled shape, thereby forming ring shapes which then tumble downwardly and the tumbling ring-shaped strips appear to the eye of the observer as a plurality of falling bubbles.

12 Claims, 2 Drawing Sheets

STREAMERS AND BUBBLES

FIELD OF THE INVENTION

This invention relates to amusement devices such as rolled strips of lightweight material, commonly called "streamers", which are thrown or otherwise ejected into the air, and more particularly, the present invention relates to similar rolls of lightweight material which release multiple pieces of the material into the air in the form of rings; such rings appearing like bubbles as they tumble and slowly float to the ground.

BACKGROUND

It has long been known to roll strips of lightweight material, such as tissue paper for example, into rolls known as streamers, and manually throw or eject such rolled streamers into the air at parties, shows, sporting events and the like. As the streamer flies through the air, the roll tumbles and the strip of material comprising the streamer partially unrolls so as to form an elongated, colored strip, the latter of which appears like a tail on a comet. Such streamers are colorful and produce a comet-like motion as they fly through the air and fall to the ground. However, each streamer produces only one object of color and motion, and the mass of the roll as it unwinds is such that it descends to the ground quite rapidly, thereby making the display quite short.

SUMMARY

The present invention provides a roll of lightweight material similar to a streamer, but comprises multiple pieces of individually rolled, relatively short strips. As the rolled device flies through the air, each of the short, individual strips unrolls separately, and each individual strip forms a small ring-like shape in the air, whereby a large plurality of small rings tumble and fall slowly downwardly giving the appearance of many colored bubbles floating to the ground. The rolled device of the present invention may also include an elongated strip, which acts as a single streamer or comet tail as it unrolls, or such single elongated strips may be eliminated and the roll may comprise only a plurality of relatively short, individual strips which form the rings or bubbles.

DETAILED DESCRIPTION

Figure 1:
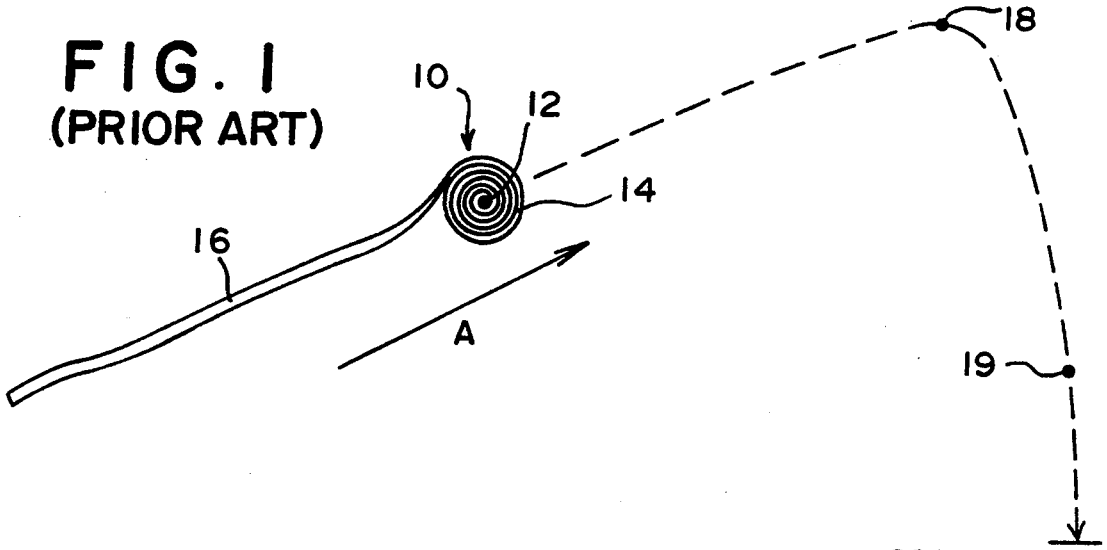
FIG. 1 (PRIOR ART)
FIG. 1 is a schematic showing of a streamer of the prior art as it flies through the air.

FIG. 1 illustrates a prior art streamer as it flies through the air. Numeral 10 indicates the head of the streamer which comprises a central core 12 about which is wound a plurality of layers 14 of a strip of lightweight material such as paper, tissue paper, Mylar or the like. As the head flies upwardly in the direction of arrow A, head 10 tumbles and partially unrolls such that the unrolled portion of the strip forms a tail 16; head 10 and tail 16 appearing like a comet as the streamer flies through the air. Whether thrown by hand, or ejected from a cannon with a compressed gas, such as $CO_2$ or air, the head quickly reaches an apogee as indicated at 18, and then falls rapidly downwardly to the ground in an almost vertical trajectory. At best, the head may become fully unwound before reaching the ground, such as at position 19, but the entire flight is quite short, and each streamer produces only one moving object. Thus, after watching a few streamers, they become relatively dull to the eye of the observer.

Figure 2:
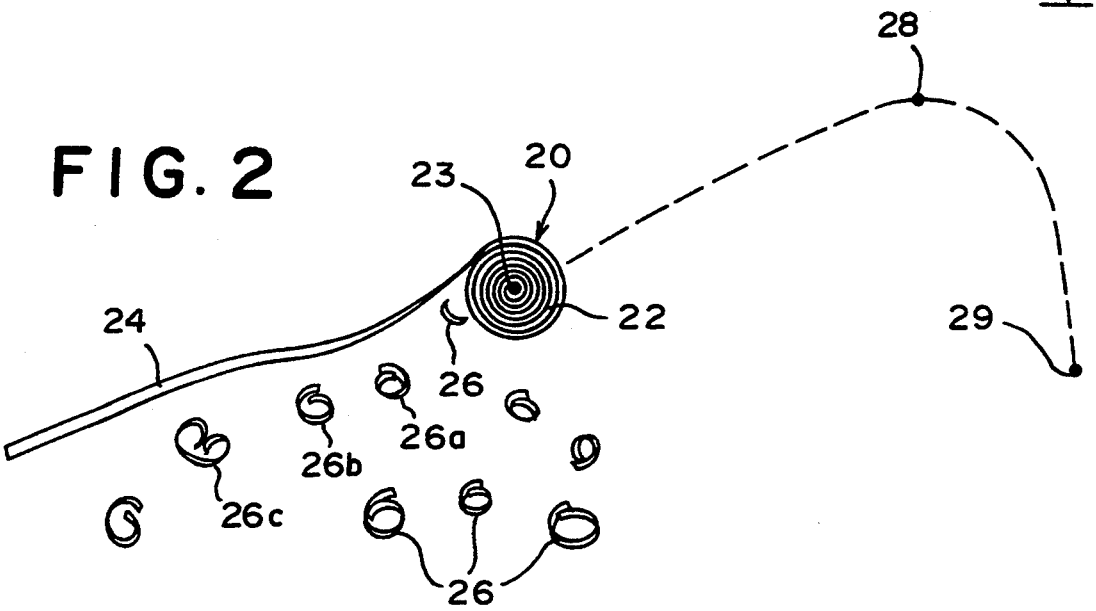
FIG. 2 is a schematic showing of a bubble-roll of the present invention as it flies through the air.

Referring now to FIG. 2, a rolled device 20 of the present invention, hereinafter referred to as a "bubble-roll", is shown as it flies through the air. In this embodiment, bubble-roll 20 includes a multi-layer head 22 rolled about a core 23 and a streamer tail 24 as in a prior art streamer. However, in addition, rolled head 22 includes a large plurality of relatively short, individually rolled strips such as strip 26 which is shown as just having dropped from unwinding head 22. Each of such individual, short strips may have a length in the order of three to seven inches, and because each such individual strip is coiled or rolled tightly in the roll, as will be more fully explained hereinafter, each individual strip tends to return to its rolled or coiled shape as soon as it is released from the unwinding head 22. Thus, each short strip 26 tends to re-wind itself and thereby forms a ring such as rings 26*a, b, c,* etc. shown in FIGS. 2 and 3.

As bubble-roll 20 continues to fly upwardly to its apogee at 28, more and more short strips 26 drop off the unwinding roll and form bubbles, and this bubble producing action continues as the roll continues toward point 29 in its trajectory. Depending upon whether the bubble-roll is to be hand-thrown, or ejected from a cannon, the length of strip 24 and the number of short strips 26 is preferably designed so that both will be fully unwound by the time the head 22 reaches a point like 29 slightly beyond the apogee. By this time, the bubble-roll has produced a cloud of bubble-like rings 26*a, b* and *c,* and each bubble-ring tumbles and floats slowly to the ground. All of the bubble-rings may be of the same color, such as pink or silver which appear as champagne bubbles, or they may be multi-colored. In either event, the eye of the observer sees many bubble-rings, such as 20 to 100 or more, each tumbling as the lightweight rings float slowly to the ground. As a result, the total display of color and motion is much more dramatic than that of a conventional streamer, and the visual effect lasts two to four times longer due to the slow, floating action of the bubble-rings as they tumble slowly to the ground.

Figure 3A:
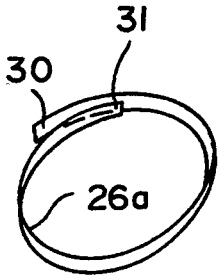
FIGS. 3*a*–3*c* illustrate three different ring shapes of bubbles of the present invention.
Figure 3B:
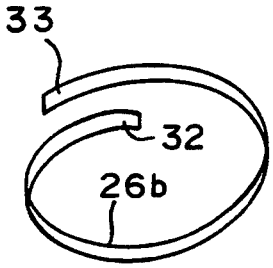

The particular shape of each ring or bubble may differ slightly depending upon the type of material and how tightly the layers of the roll are wound. For example, FIG. 3*a* illustrates an almost perfect ring shape in which ends 30, 31 of bubble 26*a* are in overlapping engagement due to the ring having been coiled tightly in a small circle near the center of the roll. In FIG. 3*b,* the ends 32, 33 of ring 26*b* are overlapped, but not in engagement, due to having being wound less tightly. However, as ring 26*b* tumbles in the air, along with hundreds of others, the same appearance of a bubble results. Similarly, ring 26*c* illustrates a further shape which may occur, particularly with longer strips. In this case, ring 26*c* has both ends 34, 35 coiled toward the center 36 of the strip such that, as it tumbles or rotates, it appears as two bubbles in one. These and other similar shapes are possible, all being generally ring-shaped as that term is used herein, and all appear as bubbles as they tumble and float relatively slowly to the ground.

Figure 4:
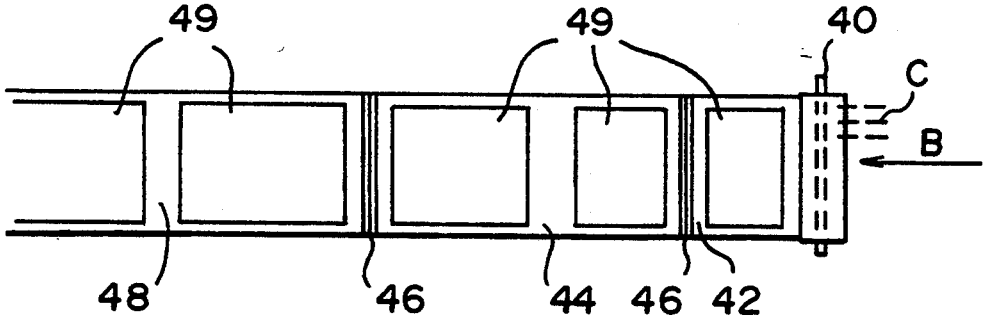
FIGS. 4–5 schematically illustrate two methods of making bubble rings to the present invention.

One preferred method of manufacture will now be described with reference to FIG. 4. Numeral 40 indicates a core which may be a solid rod or hollow tube, and which may be composed of plastic, cardboard, wood, rolled paper or the like. Core 40 may be in the order of one-eighth to one-quarter of an inch in diameter and may have a length in the order of 10 to 30 inches or more. Core 40 is placed at one end of a sheet of paper, tissue paper or Mylar 42 which may be in the order of 20 to 30 inches wide and 36 inches long, for example. The end of sheet 42 is secured to the core, as by adhesive tape or glue, and the core is rolled in the direction of arrow B in order to wrap sheet 42 around the core in many rolled layers. It will be understood that sheet 42, and subsequent sheets such as sheets 44 and 48, which are taped together by strips of tape 46, will become the elongated strip or tail 24 of the bubble-roll as previously described. Alternatively, instead of multiple sheets taped together, a continuous roll of sheet material such as paper, tissue paper or Mylar may be used.

Figure 3C:
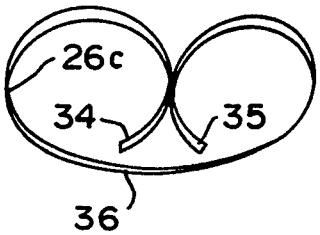

Short pieces 49 of like material are laid on top of sheets 42, 44 and 48 so that the short, individual pieces 49 are also rolled into the bubble-roll. The lengths of each of pieces 49 may increase in the direction of arrow B from the order of three inches near the core to seven or more inches at the opposite end of sheet 44. Thus, the shorter lengths are rolled closer to the core and the longer lengths are rolled at radially outwardly spaced positions so that each of pieces 49 is rolled to form at least one wrapped layer, and preferably, each of pieces 49 is rolled so as to extend 1.5 to 3 times circumferentially about the roll. That is, each of pieces 49 is rolled so as to form 1.5 to 3 layers of the roll. The width of pieces 49 is preferably the same as the width of sheets 42, 44 and 48. Pieces 49 are shown in FIG. 3 as being slightly shorter solely for the purpose of illustrating pieces 49 versus sheets 42, 44 and 48.

After sheets 42, 44, 48 and other similar sheets and all of pieces 49 have been rolled about core 40 so as to form a roll of desired size, which may be half an inch to two and one-half inches in diameter, for example, the last edge of the top sheet is taped with a piece of adhesive tape to hold the roll closed. The roll is then cut at spaced locations along the length of the roll, as indicated by dotted lines C, in order to form individual bubble-rolls 20 having widths in the order of one-quarter to one-half inch, for example. Since each of short pieces 49 have been wound or coiled between 1.5 and 3 times when wrapped into the roll, the cut widths of these pieces have a "memory" to retain their coiled, ring-like shape, and they return to such ring shapes when released from the roll as the strip formed by sheets 42, 44, 48 and other sheets become unwrapped in the air. Thus, each cut width of each of pieces 49 becomes a short strip 26 and immediately tends to re-wind itself to become a bubble-ring 26*a, b, c,* etc.

While sheets 42, 44, 48 and pieces 49 may be composed of paper or Mylar, it is preferred that they be composed of tissue paper which is both fireproof and fully biodegradable. Of course, some shiny Mylar pieces may also be added if desired, and both sheets 42, 44, 48 and pieces 49 may be composed of the same material. However, since it is desired that the sheets forming the elongated strips or tails 24 unwind rapidly, and preferably remain unwrapped during flight, while it is desired that strips 26 formed from pieces 49 re-coil themselves into bubble-rings, it is preferred that different weights of tissue paper be used since it has been discovered that different weights tend to coil differently. For example, sheets 42, 44 and 48 are preferably formed from light-weight tissue paper, such as 8 to 10 pound test, for example, which has less of a tendency to re-coil, while pieces 49 are formed from heavier weight tissue paper such as 10 to 20 pound test which has more re-coil tendency. Similarly, paper and tissue paper have more of a tendency to re-coil than Mylar such that paper or tissue paper is preferred for making strips 26 while Mylar may be preferred for elongated strips or tails 24. However, if tightly wrapped in small diameter layers near the core, Mylar may also be used for bubble-strips 26.

Figure 5:
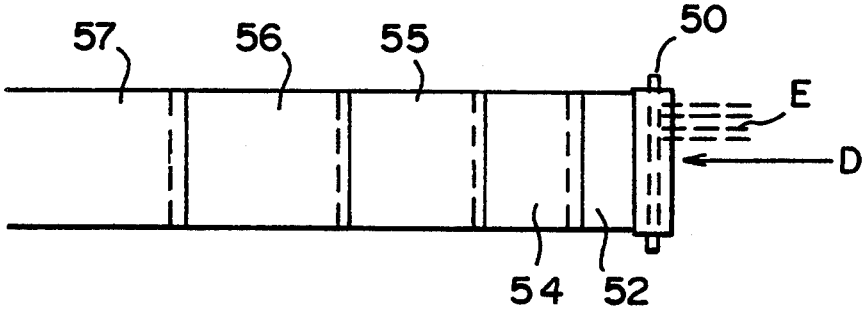

As previously indicated, bubble-rolls 20 may be made with all bubble-rings and no streamer strip 24. As shown in FIG. 5, core 50 is taped to the edge of a first short piece 52 and rolled in the direction of arrow D so that short piece 52 becomes wrapped about the core. Before the entire length of piece 52 is wrapped, a second short piece 54 is laid over the end edge of piece 52. The individual pieces 52 and 54 are not taped, but piece 54 is merely wrapped into the roll with the end edge of piece 52 overlapping the beginning edge of piece 54. Similarly, other pieces 55, 56, 57, etc. are overlapped at their edges and wrapped into the roll so that each piece is unsecured in the roll except that each piece is overlapped and surrounded by the next piece forming an outer layer. The free end of the last piece is preferably taped in place, and the roll is then cut along spaced locations indicated by dotted lines E, which are transverse to the longitudinal axis of core 50, to form finished bubble-rolls 20. When the tape is removed, and a bubble-roll is ejected into the air, the tumbling action of the roll unwinds the wrapped pieces, and each piece tends to re-coil and return to its wrapped, ring-like shape thereby becoming a bubble-ring 26*a, b, c.* Thus, the display is the same as that illustrated in FIG. 2, except that, a cloud of bubble-rings is formed without a streamer tail 24. Therefore, the eye sees only bubble-rings appearing "magically" out of a roll as it flies through the air and the roll disappears when all of the pieces comprising the roll have become bubbles.

Figure 6:
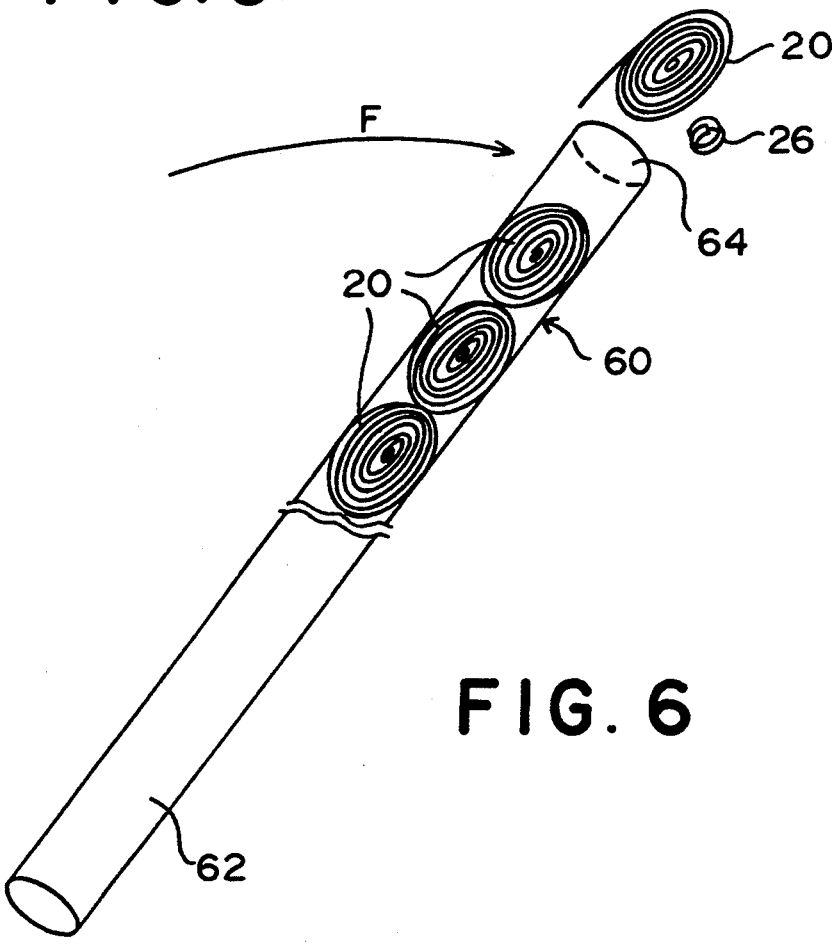
FIG. 6 illustrates bubble-rings being launched from a tube or wand.

In addition to launching bubble-rolls 20 by hand-throwing, or from a compressed gas cannon, the bubble-rings can be made to fly out of a hollow tube, or wand or cane by centrifugal force as shown in FIG. 6. Numeral 60 designates an elongated, hollow tube which may be composed of plastic or cardboard. Tube 60 may be a straight tube as shown, or it may have a handle (not shown) so as to be shaped as a dancer's cane, or tube 60 may be black with a white or silver tip so as to appear as a magician's wand. The internal diameter of the hollow tube may be in the order of one-half inch to one and a half inch; three-quarters to one inch being preferred. The length of the tube will be dependent upon its type and, for example, may be six to eighteen inches in the case of the illustrated tube, or it may be three or more feet in the case of a dancer's cane.

Tube 60 may be filled, or at least partially filled, with bubble-rolls 20 as previously described with reference to FIGS. 2–5. The diameters of the rolls, when the rolls are round, are made slightly greater than the internal diameter of tube 60. Thus, when round rolls 20 are compressed slightly between the fingers, the rolls become elliptical and may be slid easily into the tube as shown; the upper end of tube 60 being shown as composed of clear plastic for ease of illustration.

In use, the lower, closed end 62 of tube 60 is held in the hand, and when the forearm is moved rapidly forward in the direction of arrow F, and with a flick-of-the-wrist motion in the same direction, bubble-rolls 20 fly out of the open end 64 of the tube by virtue of the centrifugal force generated by the arcuate movement of the tube, represent by arrow F, and particularly the arcuate movement of upper end 64 of the tube. For example, with an 18 inch tube it is easy for either an adult or a child to eject the bubble-rolls 20 twenty or more feet into the air with very little effort. As each bubble-roll 20 exits the end of the tube, it immediately begins to unwind, and thereby begins to produce bubble-strips 26 which then tend to re-coil and become bubble-rings 26*a, b, c* etc. as previously described. One 18 inch tube may contain 12 or more bubble-rolls, and each bubble-roll may produce 30 or more bubble-rings. Thus, it will be realized that one such tube may produce a display of over 300 bubble-rings, and a longer tube such as a magician's wand or dancer's cane, may produce over 600 bubble-rings; each ring tumbling and floating slowly downward and appearing as a giant display of champagne bubbles.

It will be apparent from the foregoing description of several preferred embodiments of the present invention that numerous variations will be apparent to those skilled in the art of making confetti, streamers and the like. Therefore, it is to be understood that the foregoing disclosure is intended to be illustrative of the principles of the invention, and not limiting thereof, and that the legal scope of the invention is not intended to be limited other than as set forth in the following claims including all equivalents thereof.

What is claimed is:

1. A roll of confetti elements which, when deployed in the air, form individual rings which simulate bubbles as they fall through the air consisting of:

(a) a plurality of separate, individual strips of lightweight, non-metallic material having overlapping ends rolled in multiple coiled layers such that, when deployed in the air, each individual strip separates from the roll of adjacent strips, (b) the diameter of the roll being related to individual strip lengths such as to cause a memory to be formed in each strip so that each strip forms a substantial ring shape upon deployment in the air, and (c) said individual strips being composed of material to accept said memory such that said strips tend to return to said ring shape after being separated from the roll so as to form a plurality of bubble simulations as the ring-shaped strips tumble and float slowly downwardly.

2. The roll of claim 1 further including an elongated, hollow wand for being manually waved in the air, said wand having a predetermined internal diameter, said roll being positioned in said wand, the internal diameter of said wand and the diameter of said roll being such that said roll flies out of said wand under centrifugal force when said wand is waved in an arcuate path.

3. The roll and wand of claim 2 wherein the diameter of said roll is larger than the internal diameter of said wand such that said roll is retained by friction in said wand until said centrifugal force overcomes said friction.

4. The roll of claim 1 wherein said strips have a length in the order of 3 to 7 inches.

5. The roll of claim 1 wherein the diameter of said roll is in the order of 0.5 to 2.5 inches.

6. The roll of claim 1 wherein each of said strips is coiled about in said roll in the order of 1.5 to 3 times.

7. The roll and wand of claim 3 wherein the diameter of said roll is in the order of 0.5 to 2.5 inches and said strips are coiled about in said roll in the order of 1.5 to 3 times.

8. A roll of confetti elements which, when deployed in the air, form individual rings which simulate bubbles as they fall through the air comprising:

(a) a plurality of separate, individual strips of lightweight material selected from the group comprising paper, tissue paper and Mylar, said strips having overlapping ends rolled in multiple coiled layers such that, when deployed in the air, each individual strip separates from the roll of adjacent strips, (b) the diameter of the roll being related to individual strip lengths such as to cause a memory to be formed in each strip so that each strip forms a substantial ring shape upon deployment in the air, and (c) said individual strips being composed of material to accept said memory such that said strips tend to return to said ring shape after being separated from the roll so as to form a plurality of bubble simulations as the ring-shaped strips tumble and float slowly downwardly.

9. The roll of claim 8 wherein each of said strips is coiled about in said roll in the order of 1.5 to 3 times.

10. The roll of claim 8 wherein the diameter of said roll is in the order of 0.5 to 2.5 inches and said strips are coiled about in said roll in the order of 1.5 to 3 times.

11. The roll of claim 8 further including an elongated, hollow wand for being manually waved in the air, said wand having a predetermined internal diameter, said roll being positioned in said wand, the internal diameter of said wand and the diameter of said roll being such that said roll flies out of said wand under centrifugal force when said wand is waved in an arcuate path.

12. The roll and wand of claim 11 wherein the diameter of said roll is larger than the internal diameter of said wand such that said roll is retained by friction in said wand until said centrifugal force overcomes said friction.

* * * * *